US008686307B2

(12) United States Patent
Inagaki

(10) Patent No.: US 8,686,307 B2
(45) Date of Patent: Apr. 1, 2014

(54) METAL MESH CONTACT AND SWITCH AND METHOD FOR PRODUCING THE SAME

(75) Inventor: Shuji Inagaki, Soka (JP)

(73) Assignee: Covac Co., Ltd., Saitama (JP)

( * ) Notice: Subject to any disclaimer, the term of this patent is extended or adjusted under 35 U.S.C. 154(b) by 201 days.

(21) Appl. No.: 13/144,454

(22) PCT Filed: Dec. 11, 2009

(86) PCT No.: PCT/JP2009/070742

§ 371 (c)(1),
(2), (4) Date: Jul. 13, 2011

(87) PCT Pub. No.: WO2010/082420

PCT Pub. Date: Jul. 22, 2010

(65) Prior Publication Data

US 2011/0266129 A1 Nov. 3, 2011

(30) Foreign Application Priority Data

Jan. 15, 2009 (JP) ..... 2009-006709

(51) Int. Cl.
*H01H 11/00* (2006.01)

(52) U.S. Cl.
USPC ..... 200/530

(58) Field of Classification Search
USPC ..... 200/512, 511, 530; 439/86–91, 66; 174/392
See application file for complete search history.

(56) References Cited

U.S. PATENT DOCUMENTS 4,778,950 A * 10/1988 Lee et al. ..... 174/260
4,940,426 A * 7/1990 Redmond et al. ..... 439/495
5,047,602 A * 9/1991 Lipka ..... 200/86 R (Continued)

FOREIGN PATENT DOCUMENTS

EP 1 429 353 A1 6/2004
JP 57-109532 U1 7/1982

(Continued)

OTHER PUBLICATIONS

Extended Search Report issued in corresponding European Patent Application No. 098383854 dated Nov. 21, 2013.

*Primary Examiner* — Briggitte R Hammond
(74) *Attorney, Agent, or Firm* — Sughrue Mion, PLLC

(57) ABSTRACT

An electrical contact (1) that comprises a core body (3) made from elasticmaterial and having outer, inner and side surfaces, a metal mesh layer (5) extending to the outer and sidesurfaces of the core body (3) and a bonding layer (7) covering the edge of the metal mesh layer (5) at the side surface of the core body (3). Since the metal mesh layer (5) is provided to the outer surface (contact surface) of the core body (3), the outer surface comes in contact with the other contact surface with a number of contact points. By providing the bonding layer (7), the edge (cut surface) of the metal mesh (5) is rarely exposed to air and the rusting which occurs easily at the edge can be prevented. And, the bonding layer (7) has a function for preventing the key top material from coming into around the outer surface of the electrical contact at the process for attaching the contact (1) to the key top. Accordingly, an electrical contact capable of having a number of contact points, such as a metal mesh, prevents rust of the metal mesh and further failure of a bonding operation to a key top of a key switch can be provided.

8 Claims, 6 Drawing Sheets

(56) References Cited

U.S. PATENT DOCUMENTS

| | | | | |
|---|---|---|---|---|
| 5,441,690 | A * | 8/1995 | Ayala-Esquilin et al. | 264/277 |
| 5,915,758 | A * | 6/1999 | Alfiero | 29/854 |
| 6,264,476 | B1 * | 7/2001 | Li et al. | 439/66 |
| 7,833,020 | B1 * | 11/2010 | Ma et al. | 439/66 |
| 7,907,410 | B2 * | 3/2011 | Martin et al. | 361/708 |
| 7,964,810 | B2 * | 6/2011 | Keist et al. | 200/264 |
| 2005/0023123 | A1 | 2/2005 | Miyako | |
| 2006/0071751 | A1 | 4/2006 | Wagner et al. | |
| 2006/0141814 | A1 * | 6/2006 | Li | 439/66 |
| 2006/0141815 | A1 * | 6/2006 | Li | 439/66 |
| 2006/0180348 | A1 * | 8/2006 | Cloutier et al. | 174/350 |
| 2006/0266643 | A1 * | 11/2006 | Le et al. | 204/298.12 |
| 2009/0122491 | A1 * | 5/2009 | Martin et al. | 361/708 |

FOREIGN PATENT DOCUMENTS

| | | | |
|---|---|---|---|
| JP | 62-54433 | U | 4/1987 |
| JP | 02-260336 | A | 10/1990 |
| JP | 2004-342539 | A | 12/2004 |
| JP | 2005-116403 | A | 4/2005 |
| JP | 2005-524210 | A | 8/2005 |
| JP | 2007-176733 | A | 7/2007 |
| WO | 03/094187 | A1 | 11/2003 |

* cited by examiner

METAL MESH CONTACT AND SWITCH AND METHOD FOR PRODUCING THE SAME

CROSS REFERENCE TO RELATED APPLICATIONS

This application is a National Stage of International Application No. PCT/JP2009/070742 filed Dec. 11, 2009, claiming priority based on Japanese Patent Application No. 2009-006709, filed Jan. 15, 2009, the contents of all of which are incorporated herein by reference in their entirety.

FIELD OF THE INVENTION

The present invention relates to a low resistance electrical contact having less possibility of contact failure and a key switch using the same used for operating in-vehicle units and the like.

BACKGROUND OF THE INVENTION

For a movable contact used in a key switch, a thin metal plate contact has been commonly used. Exemplary thin metal plate contact is made such that a thin plate such a nickel silver plate and phosphor bronze plate is plated with nickel and then with gold, bonded with rubber, and then punched out into a prescribed shape.

On the other hand, in parallel with the thin metal plate contact, another contact has been disclosed (for example, patent literatures 1, 2 and 3), in which a metal wire, metal ribbon or metal mesh is embedded on a surface of a key top. In the above mentioned thin metal plate contact, since the contact surface is flat and has little flexibility, when dust is attached on the other contact surface or the other contact surface has irregularity, the flat contact surface of the thin metal plate contact may come in contact with the other contact surface in an angled posture because the dust or irregularity obstructs the direct contact. In this case, sufficient conduction cannot be obtained, causing contact failure. On the contrary, the contact embedded with a metal wire, metal ribbon or metal mesh forms a conductive uneven surface so as to come in contact with the other contact surface with a number of contact points and thereby to obtain easy contact. However, the proposal has not been given to prevent the cut edge surface of the plated metal mesh from rusting and to improve the operation for bonding the contact to a key top.

Patent literature 1: Unexamined Japanese Utility Model Publication S57-109532,

Patent literature 2: Unexamined Japanese Utility Model Publication 562-54433 and Patent literature 2: Unexamined Japanese Patent Publication 2004-342539.

SUMMARY OF INVENTION

Problems to be Resolved by the Invention

An object of the present invention is to provide an electrical contact capable of having a number of contact points such as a metal mesh, preventing rust of the metal mesh and further failure of bonding operation to a key top of a key switch.

Means of Solving the Problems

An electrical contact according to the present invention comprises a core body made from elastic material and having outer, inner and side surfaces, a metal mesh layer extending the outer and side surfaces of said core body and a bonding layer covering the edge of said metal mesh layer at the side surface of said core body.

Since the metal mesh layer is provided to the outer surface (contact surface) of the core body, a conductive uneven surface is formed on the outer surface so that the outer surface comes in contact with the other contact surface with a number of contact points. Accordingly, when dust is attached on the other contact surface or the other contact surface has irregularity, the metal mesh layer flexes along the other contact surface to obtain electrical conduction between the contacts.

Furthermore, since the metal mesh layer is provided to the side surface in addition to the outer surface of the core body and the bonding layer is provided to the side surface, the edge (cut surface) of the metal mesh is rarely exposed to air. In the case in which cupper or stainless mesh plated with gold or silver for improving electrical conductivity is cut into a predetermined shape, and the cut surface is not plated and exposed to air, the cut surface may begin to rust along a portion in contact with air. Accordingly, by covering the cut surface with the bonding layer, the rusting can be prevented.

"A metal mesh layer extending (or covering) the outer and side surfaces of said core body" does not only include a case in which the metal mesh layer extends the all area of the outer and side surfaces of the core body but also a case in which the metal mesh layer extends from the outer surface to the halfway portion of the side surface for example.

The metal mesh used in the present invention includes a metal mesh made of metal only or another metal mesh such as a resin mesh plated with metal, a metal mesh partially made of metal, and the like. The later includes a metal mesh made by weaving a metal wire and a resin wire (PP, PE, PA) alternatively. The later has an advantage of material cost.

The bonding layer is for enhancing the bonding of the electrical contact and a key top body at producing the key top. And, the bonding layer has a function for preventing the key top material from coming into around the outer surface of the electrical contact at the process for attaching the contact to the key top. As a material for the bonding layer, silicon-based material such as RTV (room temperature vulcanization) rubber may be used in the case in which the key top is made from silicon rubber. Alternatively, thermoplastic resin may be used in the case in which the key top is made from soft elastic resin.

In the present invention, the metal mesh layer is preferably folded onto the inner surface of the core body.

The electrical contact is commonly attached to the key top at the inner surface. So, by folding the metal mesh layer onto the inner surface, the cut surface of the metal mesh is not exposed to the outer and side surfaces of the core body so as to be prevented from rusting.

In the present invention, in the case where a metal mesh of the metal mesh layer is pressed to be flattened, the metal mesh reduces in thickness and thereby becomes to have flexibility, causing easy handling. And, it becomes possible to reduce the thickness of the electrical contact. Furthermore, the contact area of the metal mesh increases thereby to increase a conductive area of the electrical contact.

A key switch comprises a key top and a movable contact attached to a part of the key top, in which the key top is pushed down so that the movable contact comes in contact with a fixed contact arranged opposite to the movable contact and to provide electrical conduction between the contacts, wherein the movable contact is an electrical contact according to the aforementioned electrical contact.

A first producing method of an electrical contact comprises:

cutting a metal mesh into a predetermined shape, forming said cut metal mesh into a cup shape to form a metal mesh layer, inserting a material for a core body into the hollow of said metal mesh layer and forming a bonding layer around the side surface, or, the side and inner surfaces of said metal mesh layer.

A second producing method of an electrical contact comprises:

cutting a metal mesh into a predetermined shape, forming said cut metal mesh into a cup shape to form a metal mesh layer, inserting a material for a core body into the hollow of said metal mesh layer, folding and then pressing the edge of said metal mesh layer onto inner surface of said core body; and forming a bonding layer around the side surface, or, the side and inner surfaces of said metal mesh layer.

A producing method of a switch comprises:

setting an electrical contact produced by the above described producing method of an electrical contact on a die and forming rubber or soft elastic resin into a key top while bonding to the electrical contact.

Effect of the Invention

As described above, according to the present invention, since the metal mesh layer is provided to the outer surface (contact surface) of the core body, a conductive uneven surface is formed on the outer surface and thereby is able to come in contact with the other contact surface with a number of contact points. And, by forming the metal mesh layer to cover the side surface in addition to the outer surface of the core body and the bonding layer is further provided to the side surface, the edge (cut surface) of the metal mesh is rarely exposed to air so that the rusting of the metal mesh from the cut surface can be prevented. And, it is also prevented the key top material from coming into around the outer surface of the electrical contact at the process for bonding the contact to the key top.

BRIEF DESCRIPTION OF THE DRAWINGS

FIG. 1 are views showing a structure of an electrical contact according to the embodiment of the present invention.

DETAILED DESCRIPTION OF EMBODIMENT OF THE INVENTION

Hereinafter, preferred embodiments of the present invention will be described in detail with reference to the accompanying drawings.

Figure 1A:
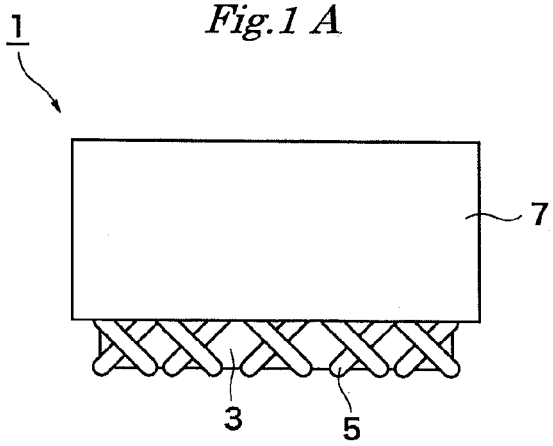
FIG. 1A is a side view.
Figure 1B:
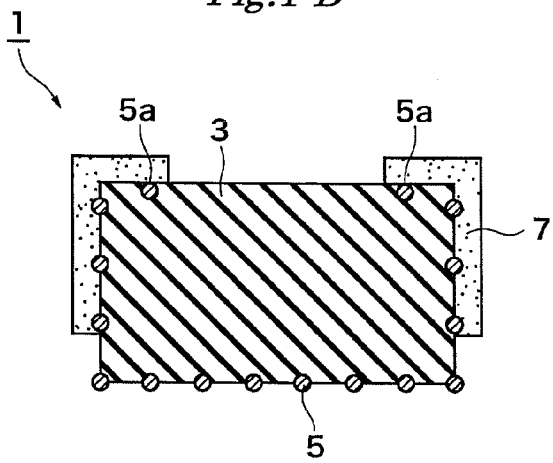
FIG. 1B is a side cross-sectional view and FIG. 1C is a bottom view.
Figure 1C:
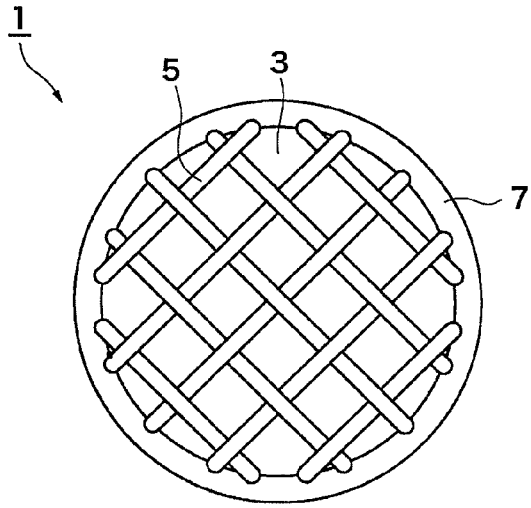

FIG. 1 are views showing a structure of an electrical contact according to the embodiment of the present invention; FIG. 1A is a side view; FIG. 1B is a side cross-sectional view and FIG. 1C is a bottom view (a plan view of the contact surface).

The electrical contact 1 comprises a disk-shaped core body 3 made from elastic material; a metal mesh layer 5 extending over the outer and side surfaces of the core body 3; and a bonding layer 7 which covers the edge of the metal mesh layer 5 at the side surface of the core body 3.

The core body 3 has a disk-shape with circular outer and inner surfaces and side surface and is made from silicon rubber, for example. The core body 3 may has an elliptical shape or a polygon with rounded corners.

The metal mesh layer 5 has a cup-shape and, in this embodiment, covers all the area of the outer and side surfaces and further the peripheral portion of the inner surface of the core body 3. A metal mesh which forms the metal mesh layer 5 is made by weaving metal fivers (for example, stainless steel, titan, nickel, copper and the like) into a mesh pattern. For example, a metal mesh made by weaving metal fivers of 0.1 mm in diameter at a pitch of 0.18 mm into a mesh pattern may be used. Furthermore, the mesh may be plated with gold for prevention of rusting and improvement in electrical conductivity. A stainless mesh plated with gold has an electric conductivity of 0.6Ω, for example. Alternatively, a metal mesh plated with gold may be used. The gold plate has a thickness of 0.1 μm or thicker for example. In this embodiment, the metal mesh layer 5 is formed so as to cover the peripheral portion of the inner surface of the core body 3; however may cover all the area of the outer surface and a part of the side surface of the core body 3, not the peripheral portion of the inner surface.

For the metal mesh, a hybrid mesh made by weaving a metal wire and a plastic fiver (PP, PE and PA) alternatively may be used. Such metal mesh has an advantage in material cost.

The bonding layer 7 is formed to cover the almost all area of the metal mesh layer 5 at the side surface of the core body 3, and, the edge of the metal mesh layer 5 which reaches the inner surface of the core body 3. The bonding layer 7 enhances the bonding of a key top and the electrical contact at a producing process of the key top, described later. Furthermore, the bonding layer 7 has a function for preventing the key top material from coming into around the outer surface of the electrical contact at the producing process. And, as shown in FIG. 1B, the bonding layer 7 is formed to cover the edge 5*a* (cut surface) of the metal mesh layer 5 so as to prevent the edge 5*a* of the metal mesh 5 from being exposed to air. Because the cut surface of the metal mesh layer 5 is not plated, exposing the cut surface to air may rust the cut surface from a portion in contact with air. So, by covering the cut surface with the bonding layer 7, the rusting can be prevented. As a material for the bonding layer 7, RTV rubber (for example, RTV rubber KE1204 (trade name) manufactured by Shin-Etsu Chemical Co., Ltd.) may be used in the case in which the key top is made from silicon rubber.

As described above, in the electrical contact 1, since the metal mesh layer 5 is provided on the outer surface (contact surface) of the core body 3, a conductive concavo-convex surface is formed so as to come in contact with the other contact surface with a number of contact points. Accordingly, if dust is attached on the other contact surface or the other surface has irregularity, the metal mesh layer 5 flexes along the shape of the attached dust or the irregularity to obtain electrical contact between the contact surfaces. And, since the edge 5*a* of the mesh metal layer 5 is covered with the bonding layer 7 not to be exposed to air, it becomes possible to prevent the rusting of the metal mesh layer.

Figure 2:
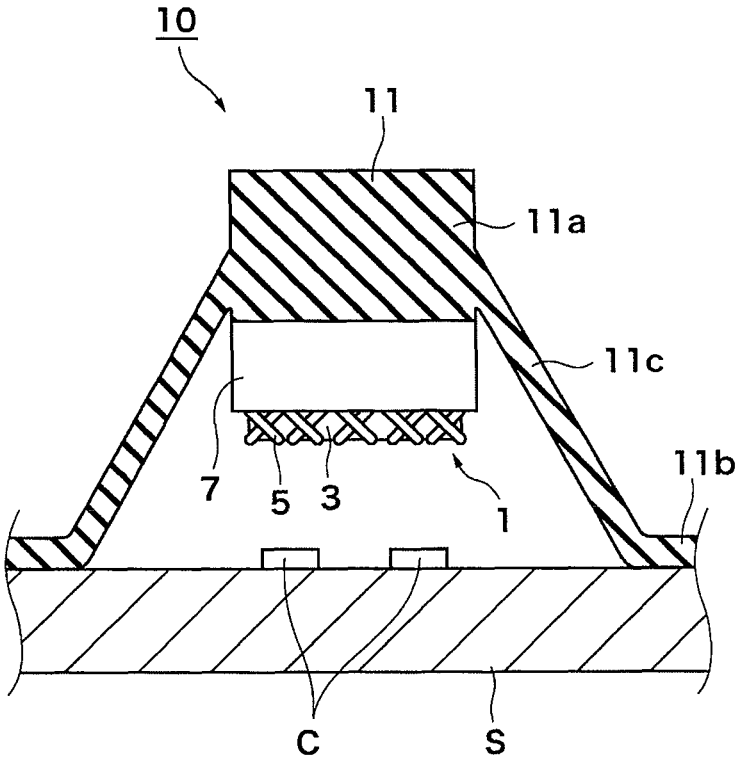
FIG. 2 is a side view showing a structure of a switch according to the embodiment of the present invention.

FIG. 2 is a side view showing a structure of the switch according to the embodiment of the present invention.

The switch 10 comprises a key top 11 and a movable contact 1, shown in FIG. 1, formed on the key top 11. On a substrate S opposite to the movable contact 1, a fixed contact C is formed. The key top 11 is made from rubber (for example, silicon rubber) or soft elastic polymer (for example, urethane resin, styrene resin or ester resin). The key top 11 is provided with an operating portion 11*a* to be pushed down; a support portion 11*b* fixed to the substrate S; and a skirt portion (bending portion) 11*c* connecting the operating portion 11*a* to the support portion 11*b*, and, extending obliquely downward. On the bottom surface of the operating portion 11*a*, the movable contact 1 is attached. By pushing down the operating portion 11*a*, the skirt portion 11*c* expands outward and flexes so that the movable contact 1 attached on the bottom surface of the operating portion 11*a* comes in contact with the adjacent fixed contacts C on the substrate 3, causing electrical conduction between the contacts.

A producing method of the electrical contact shown in FIG. 1 will be described.

Figure 3:
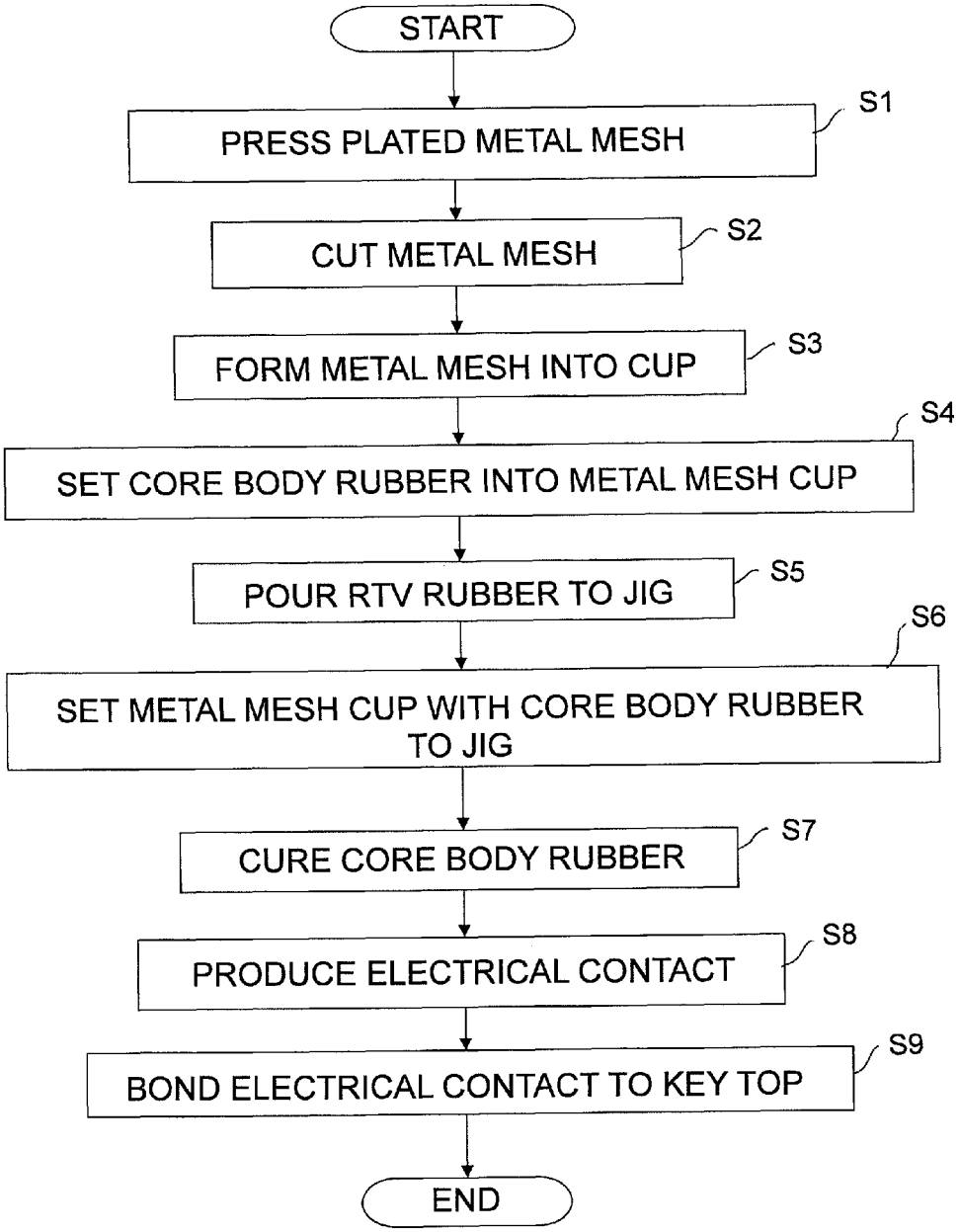
FIG. 3 is a flowchart showing a producing method of an electrical contact according to the embodiment of the present invention.

FIG. 3 is a flowchart showing a producing method of a contact according to the embodiment of the present invention. In this embodiment, a case in which the key top is made from silicon rubber will be described.

Figure 5A:
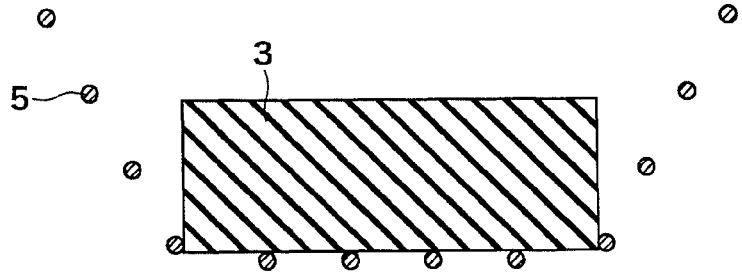
FIG. 5 are side views schematically showing another process of the producing method of an electrical contact shown in the flowchart of FIG. 3.
Figure 5B:
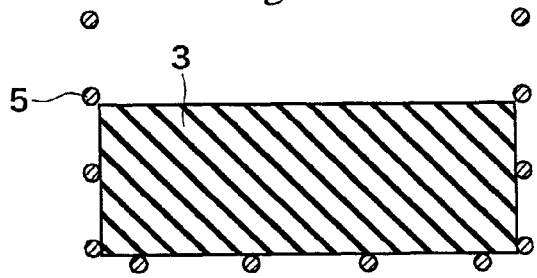
Figure 5C:
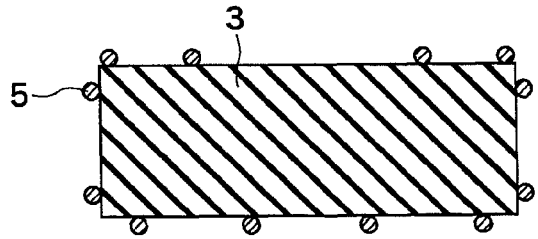
Figure 5D:
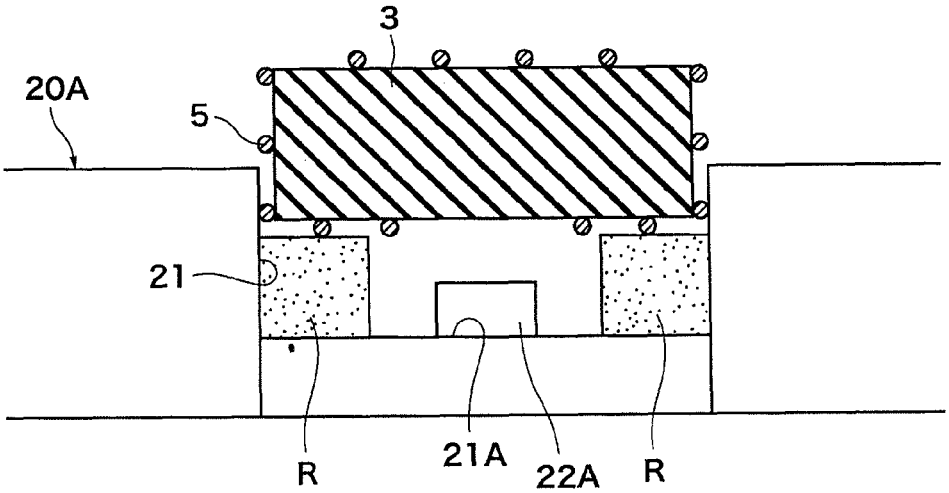
Figure 6:
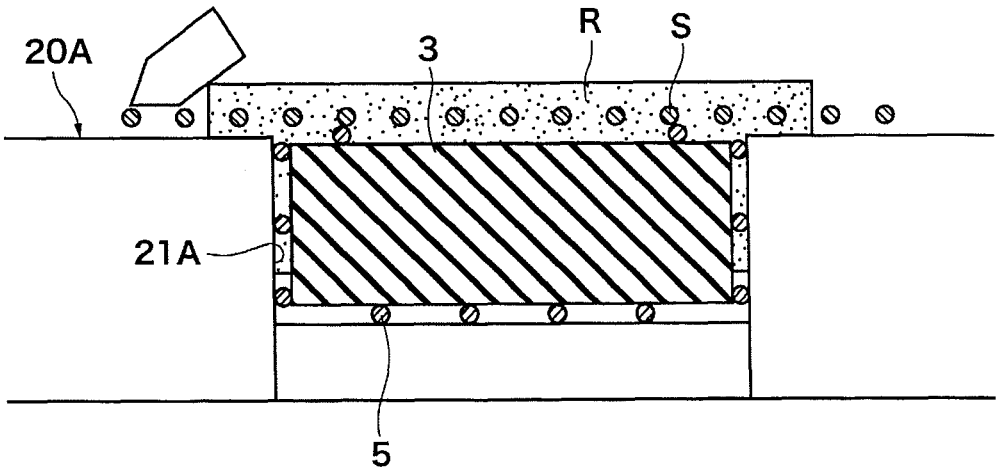
FIG. 6 are side views schematically showing still another process of the producing method of an electrical contact shown in the flowchart of FIG. 3.

FIGS. 4, 5 and 6 schematically shows a part of the flowchart of FIG. 3.

Figure 4A:
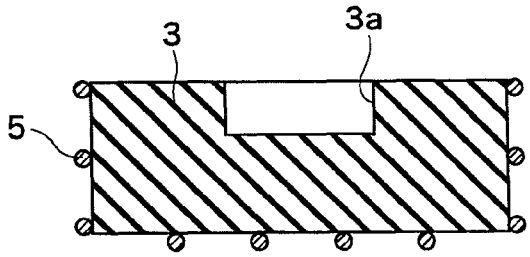
FIG. 4 are side views schematically showing a process of the producing method of an electrical contact shown in the flowchart of FIG. 3.

At Step 1, a metal mesh plated with gold is prepared and the plated metal mesh is pressed in a vertical direction to be flattened. The pressing the metal mesh to reduce the thickness provides the metal mesh flexibility and thereby easy forming at the subsequent processes. And, a contact area of the metal mesh increases thereby to increase a conductive area of the electrical contact. However, the pressing is not necessarily. And, at Step 2, the metal mesh is cut into a predetermined shape (for example, octagon with a diameter of 4 mm) (Alternatively, the metal mesh may be cut after forming into a cup-shape). Then, at Step 3, as shown in FIG. 4A, the cut mesh 5 is formed with a press machine into a cup-shape having a circular bottom wall and a side wall standing from the periphery of the bottom wall almost perpendicularly. The bottom wall has a diameter of 3 mm, for example. In this embodiment, a case in which the metal mesh layer does not cover the inner surface of the core body but covers the all area of the outer surface and a part or almost of the area of the side surface of the core body will be described (a case in which the metal mesh layer covers the inner surface of the core body will be described later).

At Step 4, rubber formed into a predetermined shape, which becomes the core body 3, is set into the hollow portion of the metal mesh cup 5. In this embodiment, the core body 3 is a disk-like shape having a diameter of 2.5 mm and a thickness of 0.4 mm. As shown in FIG. 4A, a positioning recess 3*a* for setting on a jig is formed on one surface of the core body 3. The core body 3 is set into the hollow portion of the metal mesh cup 5 with the surface formed with the recess 3*a* upward. The under surface of the core body 3 is covered with the metal mesh 5. The under surface is covered with the metal mesh 5 and becomes a surface of the electrical contact.

Figure 4B:
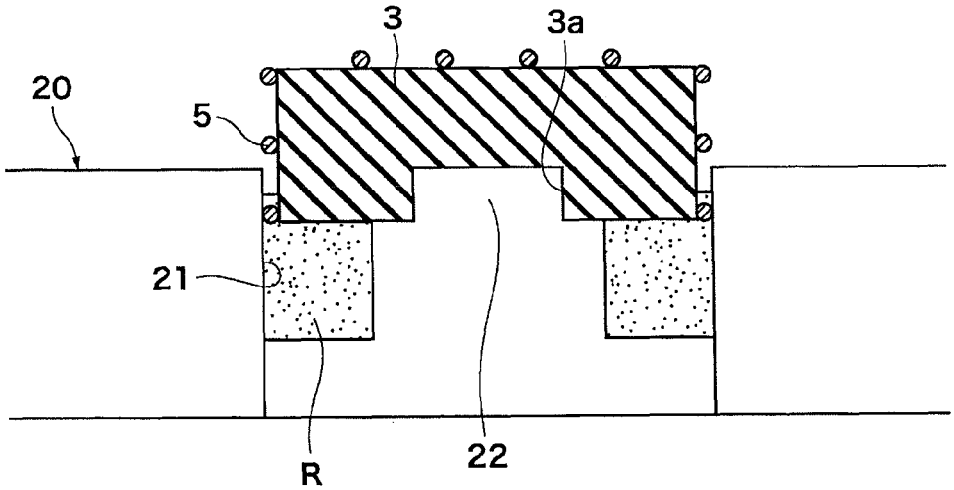

At Step 5, RTV rubber is poured into a jig for forming a bonding layer. As shown in FIG. 4B, the jig is formed with a circular recess 21 and a positioning protrusion 22 is formed on the center of the recess 21. The RTV rubber R is poured into the recess 21 around the protrusion 22. At Step 6, as shown in FIG. 4B, the metal mesh cup 5 in which the core body 3 is set is installed to the jig 20 with the surface (outer surface) covered with the metal mesh 5 upward. At this time, the positioning recess 3*a* of the core body 3 is positioned with the positioning protrusion 22 of the jig 20. At Step 7, the jig 20 together with the core body 3 covered with the metal mesh cup 5 is set in a curing furnace to cure the rubber. The RTV rubber R cures around the side surface and the peripheral portion of the surface (inner surface), which is not covered with the metal mesh 5, of the core body 3. Thereby, the cut surface of the metal mesh 5 is covered with the RTV rubber. And then, the jig 20 is get out of the curing furnace and the core body 3 covered with the metal mesh cup 5 is detached from the jig. Thereby the electrical contact 1 (as shown in FIG. 1) is produced (Step 8).

Figure 4C:
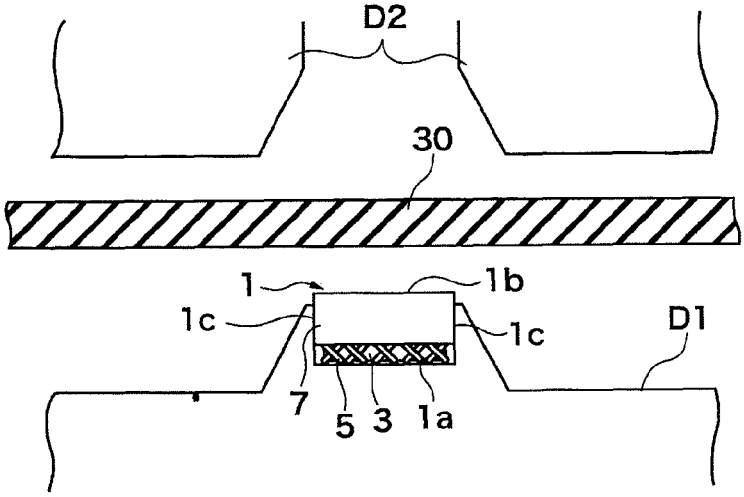

Subsequently the produced electrical contact 1 is set into a lower die D1 of an insert forming die having upper and lower dies D1 and D2, as shown in FIG. 4C. At the setting, the outer surface 1*a* (surface covered with the metal mesh 5) of the electrical contact 1 is set downward. Then, silicon rubber 30 (including vulcanizing agent) which is a material of a key top is pored or sandwiched between the upper and lower dies to carry out an insert forming. The insert forming is carried out while heating at a temperature or higher at which either the silicon rubber of the core body 5 and the RTV rubber of the bonding layer 7 or the silicon rubber 30 which is a material of the key top, or, both of them begin to be reacted each other on the inner surface 1*b* of the electrical contact 1. The insert forming is commonly carried out while pressing. Then, one or both rubbers are reacted to begin to be bonded at the boundary. During the reaction, since the bonding layer 7 made from RTV rubber exists on the side surface 1*c* of the electrical contact 1, it is prevented from the silicon rubber 30 of the key top material from coming into around the outer surface 1*a* (surface covered with the metal mesh 5) from the side surface 1*c* of the electrical contact 1. Under such condition, both of the rubbers are cured at the boundary to bond the silicon rubber 30 of the key top material and the rubbers of the electrical contact 1. Thereby the key switch 10 (shown in FIG. 2) is produced (Step 9).

When the metal mesh layer is formed so as to cover the peripheral portion of the inner surface of the core body as shown in FIG. 1, at Step 3, the metal mesh 5 is formed into a cup-shape having a circular bottom wall and a side wall standing from the periphery of the bottom wall obliquely outward as shown in FIG. 5A. And, at Step 4, the formed rubber (for example, 2.5 mm in diameter) which forms the core body 3 is inserted. In this case, the core body 3 is not provided with a positioning recess on one surface. When it is possible to position the elements by a positioning control of a part handling mechanism, the positioning recess may not be provided like this case.

As shown in FIG. 5B, the mesh 5 is formed so that the side wall of the mesh 5 stands almost upright along the side surface of the core body 3. And, as shown in FIG. 5C, the edge of the mesh 5 is pushed inward from the periphery of the inner surface of the core body 3 and then the inner surface is pressed. Thereby, the edge of the metal mesh 5 is folded onto the inner surface of the core body 3. The surface onto which the edge portion of the core body 3 is folded becomes the inner surface of the electrical contact. And, as with Step 6, as shown in FIG. 5D, the metal mesh cup 5 into which the core body 3 is inserted is set to a jig 20A with the surface (outer surface) covered with the metal mesh 5 upward, in which RTV rubber has been poured into the jig 20A. The circular recess 21A of the jig 20A is formed with a positioning protrusion 22A for positioning the core body 3 in the vertical direction. The core body 3 is set on the positioning protrusion 22A. The core body 3 may be positioned in the vertical direction by another way. At Step 7, when the rubber is cured, the RTV rubber R is cured around the side surface and the surface (inner surface), which is not covered with the metal mesh 5, of the core body 3 and the cut surface of the metal mesh 5 is covered with the RTV rubber. The succeeding processes are the same as the processes after Step 8.

In this embodiment, the bonding layer 7 may be formed by a screen printing. In this case, as shown in FIG. 6, the metal mesh 5 into which the core body 3 is inserted is set in the recess 21A of the jig 20A with the surface (outer surface) covered with the metal mesh 5 downward. Then, a SUS screen S is set on the upper surface of the jig 20A and the RTV rubber R is printed over the screen S. Thereby, the RTV rubber comes around the all area of the upper surface (surface onto which the edge of the metal mesh is folded, inner surface) and the partial area of the side surface of the metal mesh cup 5 into which the core body 3 is inserted, thereby forming the bonding layer 7.

EXAMPLE

First, a metal mesh was prepared. The metal mesh is one produced by weaving stainless wires of a diameter of 0.1 mm into a mesh pattern at a pitch of 0.18 mm and then plating with gold (a thickness of the plate is 0.1 μm or thicker). The mesh after the plating with gold has a electrical resistivity of 0.6Ω. Then, the metal mesh was pressed with a press machine in the vertical direction. And, the pressed metal mesh was cut into an equilateral octagon of a diameter of 4 mm. The cut metal mesh was set to a press machine and formed into a cup-shape with a pin of a diameter of 3 mm.

In parallel with, silicon rubber (KE9710U (trade name), manufactured by Shin-Etsu Chemical Co., Ltd.) was formed into a disk of a diameter of 2.5 mm and a thickness of 0.4 mm. On one surface of the formed rubber, a positioning recess of a depth of about 0.2 mm was formed. The formed rubber was set into the hollow of the metal mesh cup with the surface provided with the recess upward.

The RTV rubber (KE1204 (trade name), manufactured by Shin-Etsu Chemical Co., Ltd.) was pored in the recess of the aforementioned jig 20 (as shown in FIG. 4B). Then, the metal mesh cup into which the formed rubber was set was set to the jig with the all area of the surface covered with the metal mesh upward (with the positioning recess downward). The positioning recess of the core rubber was positioned with the positioning protrusion of the jig. The jig was set into a vulcanizing furnace and heated at 100° C. for 15 minutes to cure the rubber.

EXPLANATION OF REFERENCES

1 electrical contact
3 core body
5 metal mesh
7 bonding layer
10 switch
11 key top
20 jig
21 recess
22 positioning protrusion
30 silicon rubber

What is claimed is:

1. An electrical contact comprising:

a core body made from elastic material and having outer, inner and side surfaces, a metal mesh layer extending the outer and side surfaces of said core body and a bonding layer covering the edge of said metal mesh layer at the side surface of said core body and preventing a key top material from coming into around the outer surface of the electrical contact at the process for attaching the contact to the key top.

2. An electrical contact according to claim 1, wherein a metal mesh of said metal mesh layer is pressed to be flattened.

3. A key switch comprising a key top and a movable contact attached to a part of the key top, in which the key top is pushed down so that the movable contact comes in contact with a fixed contact arranged opposite to the movable contact and to provide electrical conduction between the contacts, wherein said movable contact is an electrical contact according to claim 1.

4. An electrical contact or a key switch according to claim 1, wherein said metal mesh is made by weaving a metal wire and a resin wire.

5. An electrical contact comprising:

a core body made from elastic material and having outer, inner and side surfaces, a metal mesh layer extending the outer and side surfaces of said core body and being folded onto the inner surface of said core body and a bonding layer covering said metal mesh layer at the side surface of said core body and the edge of said metal mesh layer folded onto the inner surface of said core body, and preventing a key top material from coming into around the outer surface of the electrical contact at the process for attaching the contact to the key top.

6. A producing method of an electrical contact comprising:

cutting a metal mesh into a predetermined shape, forming said cut metal mesh into a cup shape to form a metal mesh layer, inserting a material for a core body into the hollow of said metal mesh layer and forming a bonding layer around the side surface, or, the side and inner surfaces of said metal mesh layer, which prevents a key top material from coming into around the outer surface of the electrical contact at the process for attaching the contact to the key top.

7. A producing method of a switch comprising:

setting an electrical contact produced by the producing method of an electrical contact according to claim 6 on a die and forming rubber or soft elastic resin into a key top while bonding to the electrical contact.

8. A producing method of an electrical contact comprising:

cutting a metal mesh into a predetermined shape, forming said cut metal mesh into a cup shape to form a metal mesh layer, inserting a material for a core body into the hollow of said metal mesh layer, folding and then pressing the edge of said metal mesh layer onto inner surface of said core body; and forming a bonding layer around the side surface, or, the side and inner surfaces of said metal mesh layer, which prevents a key top material from coming into around the outer surface of the electrical contact at the process for attaching the contact to the key top.

* * * * *